United States Patent [19]

Bonerb

[11] Patent Number: 4,574,984

[45] Date of Patent: Mar. 11, 1986

[54] MATERIAL-HANDLING AND DISCHARGE BIN OF THE TYPE HAVING A FLUID-EXPANDABLE FLEXIBLE MEMBRANE FOR DISCHARGE ASSISTANCE

[75] Inventor: Timothy C. Bonerb, East Amherst, N.Y.

[73] Assignee: Vincent C. Bonerb, Boston, N.Y. ; a part interest

[21] Appl. No.: 500,821

[22] Filed: Jun. 3, 1983

[51] Int. Cl.[4] ..... B65D 88/62

[52] U.S. Cl. ..... 222/61; 222/64; 222/386.5; 222/309

[58] Field of Search ..... 222/95, 105, 203, 386.5, 222/389, 61, 64

[56] References Cited

U.S. PATENT DOCUMENTS 2,956,839 10/1960 Hermanns ..... 222/386.5
3,396,762 8/1968 Paton ..... 222/386.5 X
4,169,543 10/1979 Hall ..... 222/64 X

FOREIGN PATENT DOCUMENTS 2512790 3/1983 France ..... 222/386.5
1089874 11/1967 United Kingdom ..... 222/386.5
1144162 3/1969 United Kingdom ..... 52/197

*Primary Examiner*—Joseph J. Rolla
*Assistant Examiner*—Frederick R. Hendren
*Attorney, Agent, or Firm*—Bernard, Rothwell & Brown

[57] ABSTRACT

Improvements in bulk storage and handling systems of the type utilizing an inflatable membrane silo liner are disclosed. The inflatable liner is secured to the bin discharge opening to insure total material discharge, and the inflatable membrane is conformable to the silo or bin walls. A control system is provided incorporating safety features designed for safe and reliable operation during the discharge cycle. The unique features disclosed are equally applicable to bins or silos having central or side discharge openings.

20 Claims, 25 Drawing Figures

FIG. 4.
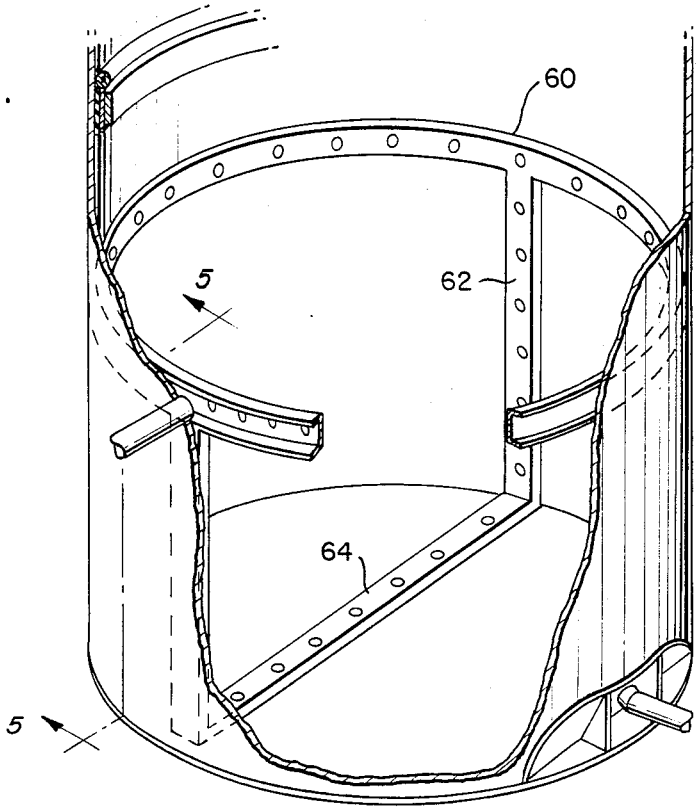
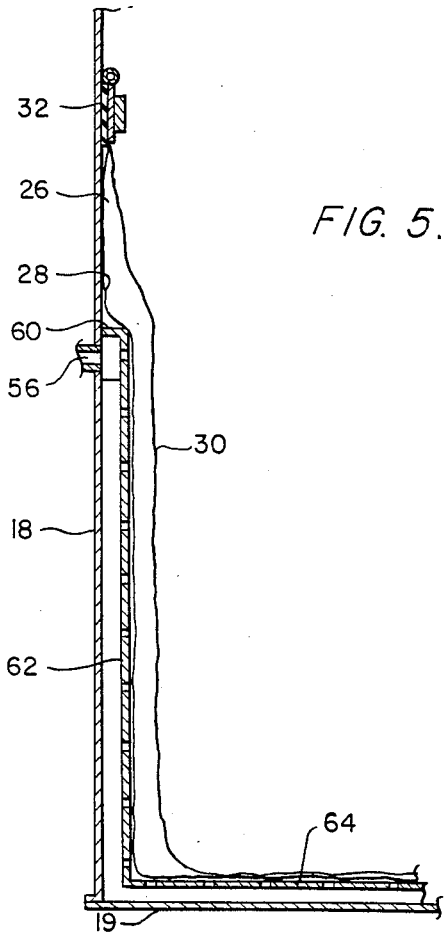
FIG. 5.

24
22
12
32
36
103
30
34
94
28
26
R
60
56
46
M
48
96
42
111
54
76
70
44
LS
16
76'
PRESSURE
RELIEF
VALVE
P
52
200
TO
ATMOSPHERE
A
105
B
C
92
FROM
ATMOSPHERE
101
95
100
102
104
106
97
99
LS
M
93
90
91
LS
88
89
84
86
M
M
M
82
58

MATERIAL-HANDLING AND DISCHARGE BIN OF THE TYPE HAVING A FLUID-EXPANDABLE FLEXIBLE MEMBRANE FOR DISCHARGE ASSISTANCE

BACKGROUND OF THE INVENTION

1. Field of the Invention

This invention relates to improvements in bulk storage and handling systems and particularly to such systems that utilize a flexible inflatable membrane silo liner which inflates under low pressure to gently roll and push material into the angle of repose.

2. Background Art

Although material handling and storage bins such as silos have been known and widely used almost since the dawn of civilization, there is little art on such bins with flexible membrane fluid-assisted discharge. Such art as is known to Applicant has been cited against commonly owned applications, Ser. No. 257,604 filed Apr. 27, 1981, now U.S. Pat. No. 4,421,250, Ser. No. 307,089 filed Sept. 30, 1981, now U.S. Pat. No. 4,496,646, Ser. No. 357,589, filed Mar. 12, 1982, and Ser. No. 357,592 filed Mar. 12, 1982, now U.S. Pat. No. 4,476,998, as well as PCT International application publication No. WO82/03839.

The most relevant of this background art appears to be U.K. Patent No. 1,144,162 published March 1969 which shows a silo with a single flexible liner inflated from the bottom and having none of the sophisticated details and controls which would be necessary to make such silo a success from an operational standpoint.

In connection with the actual construction and installation of such silos using a flexible membrane discharge of the type disclosed in the above-identified prior applications, a number of vexing problems have surfaced. One of these problems involves the inner wall of the flexible membrane for large bins trapping the bulk of the granular materials in its folds as it is expanded thus preventing complete discharge. This is particularly a problem with large bins and it appeared to be insolvable.

Another problem which exists in such bins concerns the incomplete discharge of the material from the bottom of the bin. For example, even though the bin may hold 10,000 pounds of material and the flexible membrane assists in discharging substantially all of the material, a small amount of material such as 50 pounds or more which might remain in the bottom or on top of the clamping ring adjacent the discharge opening is undesirable. If the flexible membrane is clamped to the discharge opening by a clamping ring it cannot operate to discharge the material on top of the clamping ring, and therefore leaves an undesirable amount of material remaining in the bag.

Additionally, it has been found in connection with the commercial size and scale bins that there is need for maintaining the outer wall of the dual-walled flexible membrane bag adjacent the silo wall. The outerwall of the bag is clamped to the silo wall near its top to hold it up, but there is nothing to cause it to conform to the silo wall at an intermediate position and no readily accessible means for causing it to do so.

Additionally, the prior art does not disclose any effective means for control of not only the discharge cycle and preparation of the silo for refilling, but for the overall cyclical sequence together with safety controls to prevent damage to the expensive membrane in the event of accidental overpressure within the bag.

SUMMARY OF THE INVENTION

This invention provides improvements in bulk storage handling systems of the type utilizing an inflatable membrane silo liner. It provides means for preventing the membrane from trapping the stored bulk material in its folds during the final stages of discharge by clamping the membrane around the discharge opening with a uniquely shaped clamping ring. However, the broad face of the clamping ring prevents some material in the bottom of the bin from being discharged so the invention further provides a means for discharging the material which would otherwise rest on a clamping ring. This means is in the form of a secondary or auxiliary inflatable flexible membrane. The invention also provides a means for holding the outer wall of a dualwalled flexible membrane to the wall of the silo intermediate to top and bottom thereof, this means includes a vacuum channel in communication with an auxiliary blower and a perforated channel inside the silo wall and outside the outer wall of the primary inflatable membrane. More specifically, the perforated vacuum channel is connected to the intake of a blower for applying vacuum and holding the outer wall of the membrane in place. Additionally, the storage/handling bin of this invention includes automatic safety switches to monitor the system pressure and effectively shutdown the system should a malfunction occur.

DETAILED DESCRIPTION OF THE DRAWINGS

FIG. 4 is a perspective view with portions broken away of a bin showing the vacuum channels for retaining the outer wall of the membrane adjacent the bin wall during the discharge cycle.

FIG. 5 is a detailed sectional view taken along line 5—5 of FIG. 4.

FIGS. 11A—11F are a series of schematic views showing the sequence of conditions and actions in unloading the bin.

Figure 12B:
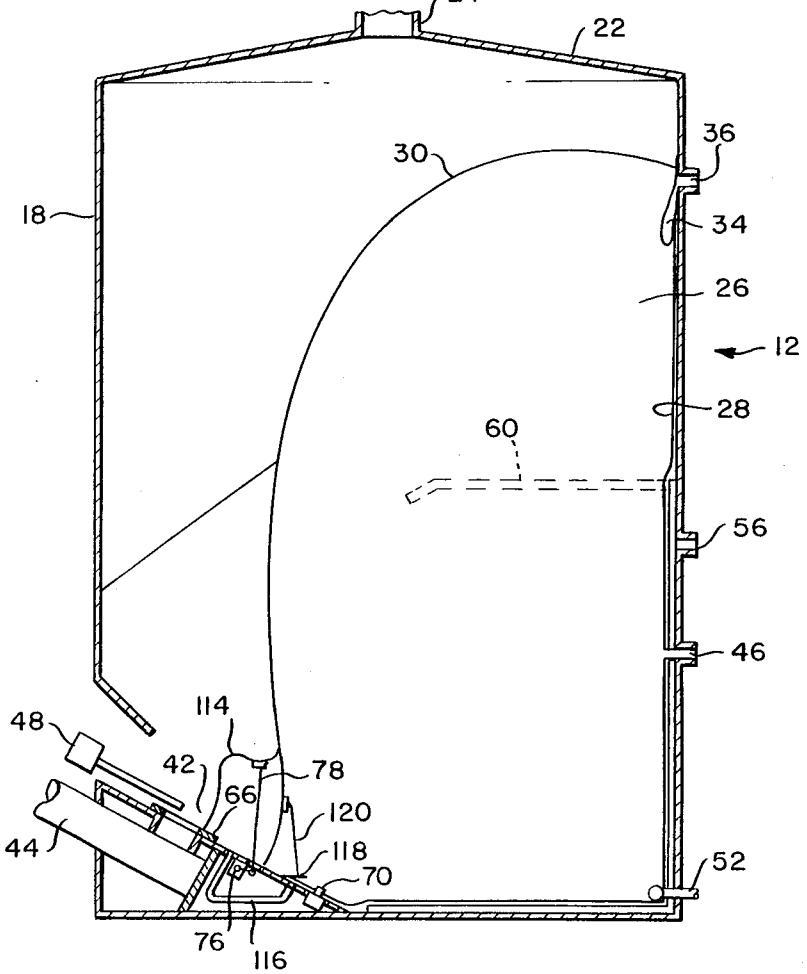
Figure 12A:
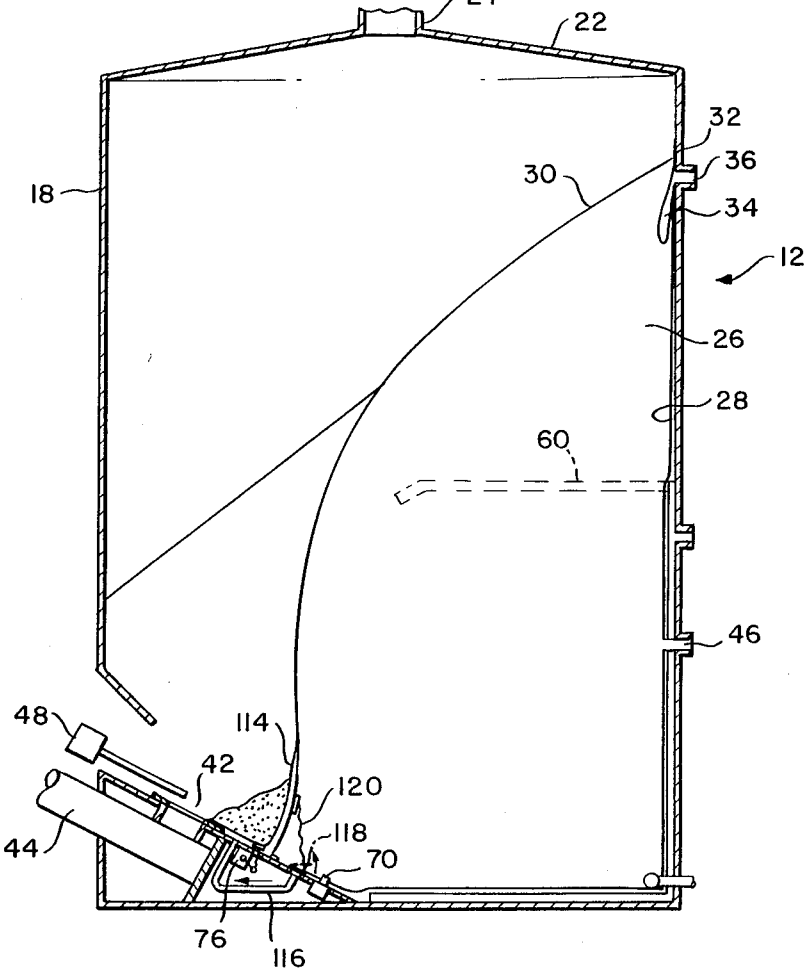

FIGS. 12A and 12B are a series of sectional elevational views, partially schematic, showing the components and positions of the auxiliary and primary inflatable membranes of this invention during the discharge cycle.

Figure 13:
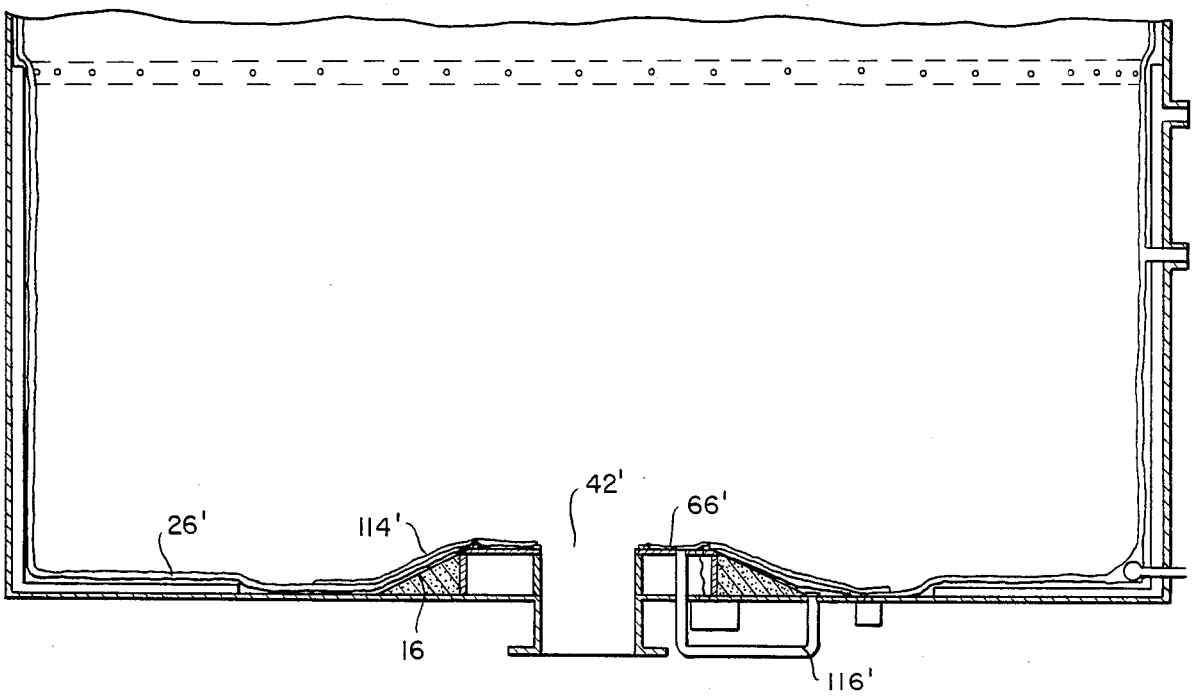

FIG. 13 is another embodiment of this invention showing a sectional elevational view, partially schematic, of the components and positions of the auxiliary and primary membranes during the discharge cycle in a center-discharge bin.

Figure 14:
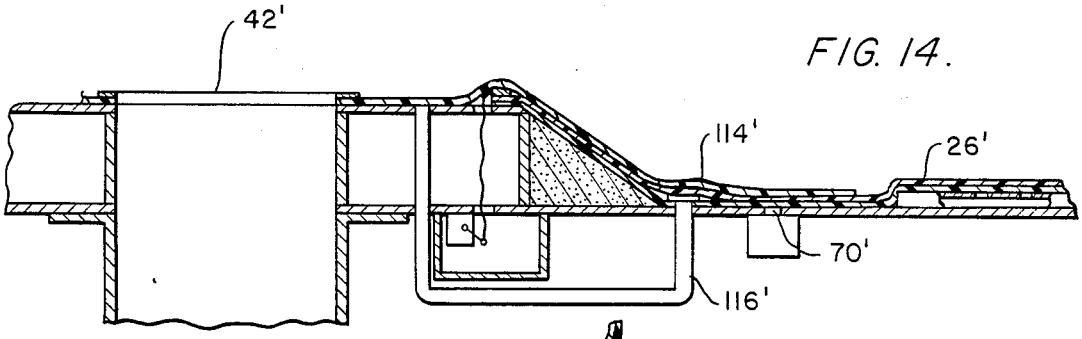

FIG. 14 is a sectional view taken along line 14—14 of FIG. 13.

Figure 15:
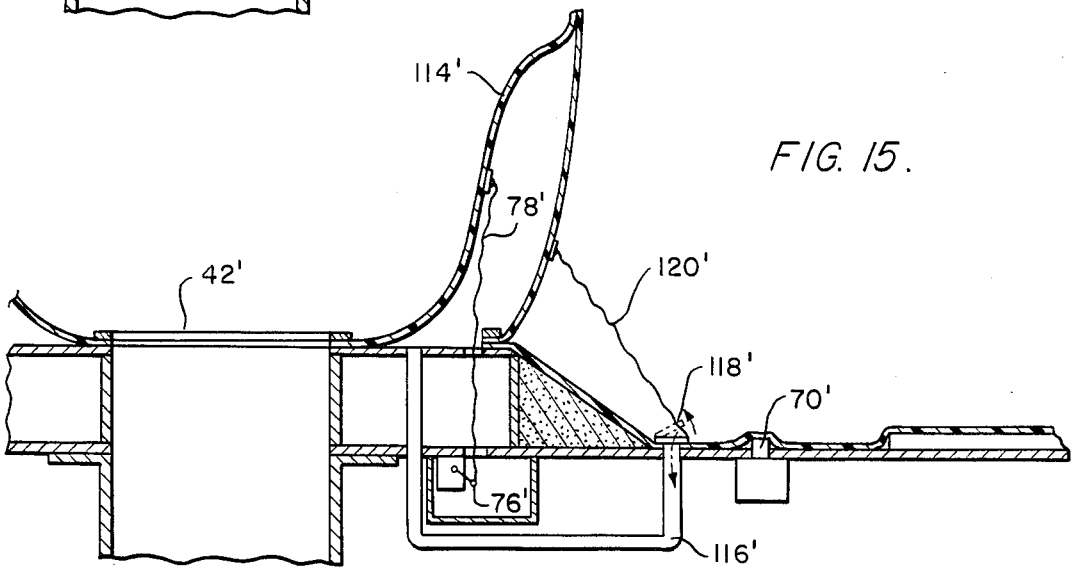

FIG. 15 is a detailed view similar to FIG. 14 showing the components and other positions during the discharge cycle.

Figure 16:
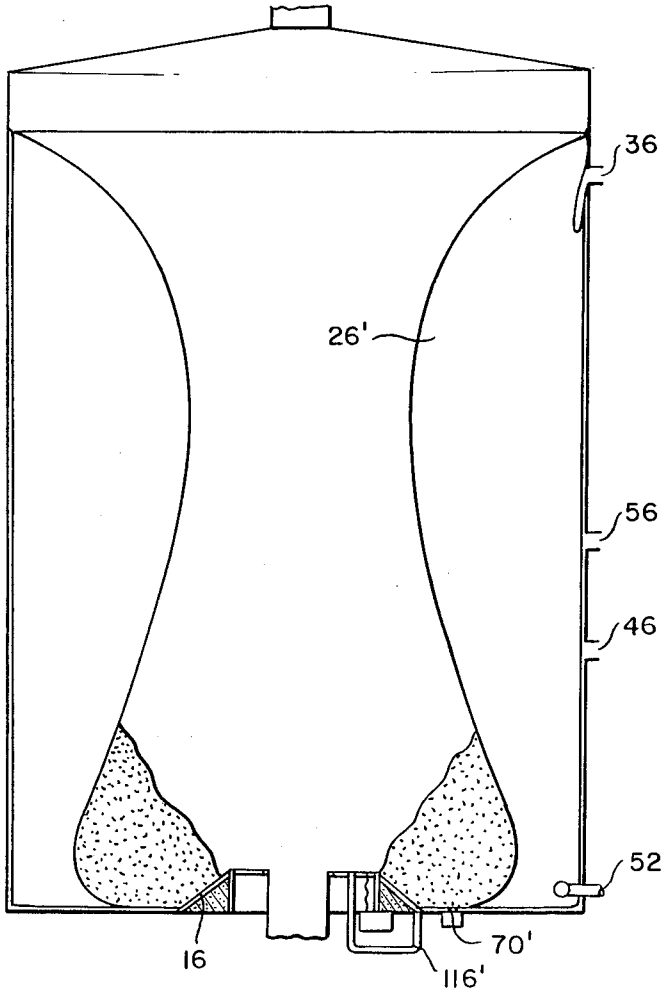

FIG. 16 is a sectional elevational view, partially schematic showing the components and positions of the auxiliary and primary membrane liners during the discharge cycle in a center-discharge bin.

Figure 17:
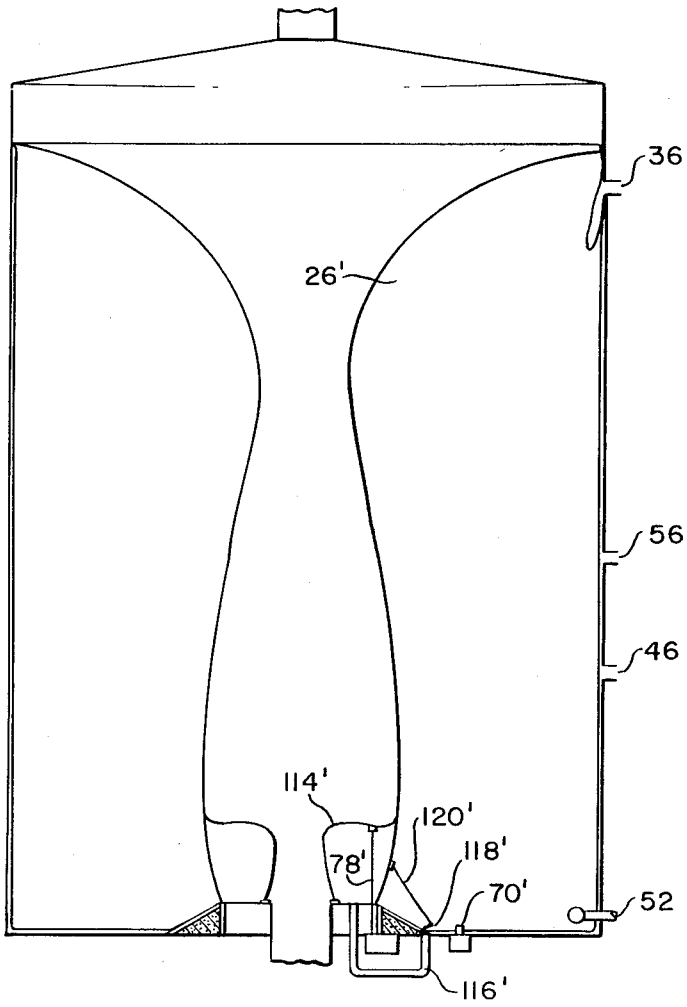

FIG. 17 is a view similar to FIG. 16, showing the auxiliary and primary membrane liners fully inflated.

DETAILED DESCRIPTION OF THE PREFERRED EMBODIMENTS

With reference to the drawings, a bin 12 of this invention is especially suitable and adapted for bulk storage and handling (discharging) free flowing or granular material of varying degrees of flowability or susceptivity to caking or bridging (rat-holing). The bin is supported on a floor or other support 14 having inclined shelf portion 16, and of suitable strength to bear the load of the material in the bin. The bin is constructed with side walls 18 which are preferably of light weight steel panels. The side walls 18 have formed therethrough a discharge opening 20 in the lower portion thereof.

The bin is optionally provided with a suitable top 22 which may be either metal or cloth and preferably has vent means therein (not shown) to allow venting of air from the bin when it is being filled while preventing loss of dirt size particulate material. A material inlet 24 is provided for the introduction of particulate material into the bin. The bin is also provided with an inflatable, double-walled, flexible generally cup-shaped bag or membrane 26 having outer and inner walls 28 and 30 respectively. The bag is secured by clamp 32 or other support means to the side wall of the bin and includes a separately inflatable slack-creative balloon or annulus 34 with a separate inflation opening 36. The slack created by the annulus above the angle of repose near the top of the flexible side walls of the cup-shaped bag eliminates undue stress at that point during the initial inflation period. The bag 26 provides a bottom 38 and side wall 40 for storing a free-flowing granular material M which may be discharged through a discharge opening 42 equipped with a suitable type gate or valve (not shown) to control the discharge of material from the bin.

To discharge the free flowing granular material from a bin constructed in accordance with this invention, the gate of the discharge opening 42 is opened. The contents of the bin may then flow out the opening to be carried away by a conveying means 44, such as a screw conveyor, or to be discharged into a moveable container for transport to a different area. The free flowing granular material will continue to flow out of the bin through the discharge port by gravity until the angle of repose for the particular material in the bin is reached, or nearly reached. At the angle of repose, the inner face R of the free flowing material assumes an inverted cone shape with its apex at the discharge opening and discharge of the material by gravity stops.

To overcome the angle of repose and complete the discharge operation, an air inlet 46 is provided for gradually inflating the membrane 26 to flow the material into a conical area inside the angle of repose for continually discharging the particlar material. Air under low pressure is forced into the bag between the inner and outer walls. The bag begins to inflate at the top of the membrane and bulge inwardly toward the center of the bin. This inflation forces the free flowing granular material nearest the top of the inverted cone to cascade down toward the discharge opening by gravity.

A sensor or probe 48 is positioned adjacent the inclined shelf and the discharge opening for detecting whether the particulate material is filling or not filling the discharge conveyor. When it senses no material flowing through the discharge opening the bin level probe sends a signal to a control box 50 (see FIG. 10) to start inflating the bag by relatively low pressure from blower system 82 having dual blowers 84 and 86. The probe operates in concert with other controls as discussed in more detail below to cause the discharge to be cyclical and the membrane to be periodically inflated as required by the material flowing into the discharge opening.

Figure 3A:
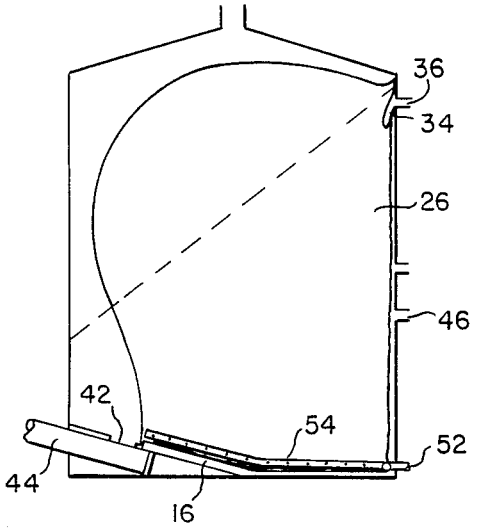
FIGS. 3A-3B are a series of schematic views showing the sequence of conditions and actions in deflating the dual-walled flexible membrane.
Figure 3B:
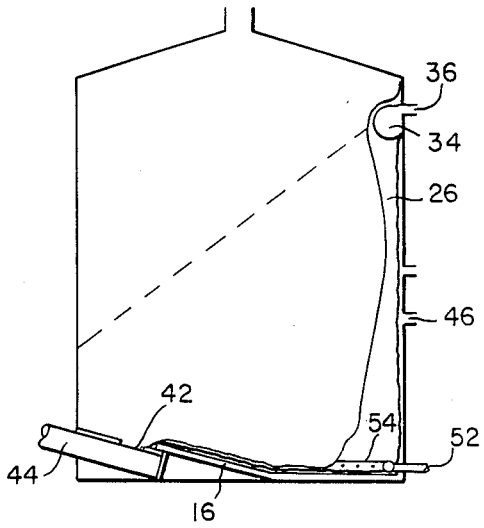

A vacuum line 52 connected to a perforated vacuum hose 54 (see FIGS. 3A and 3B) is positioned between the walls of the bag 26 at the outside periphery of the bottom to assure that the bag assumes its original position during deflation. The perforated vacuum hose is anchored through the membrane outer wall to effectively anchor the outer wall around the periphery of the bottom.

Referring now to FIGS. 4 and 5, there is shown an arrangement for keeping the outer wall 28 of the dual-walled flexible membrane 26 against the wall 18 and bottom 19 of the bin at intermediate and lower positions. This is accomplished by a vacuum connection 56 leading to an auxiliary blower 58 (see FIG. 10) in the fluid pressure control of the system. The vacuum connection is in direct communication with circular hoop 60 running around the inside of the wall of the bin and that in turn is connected to down channels 62 and a cross-bottom channel 64 all of which are perforated at the top. By applying vacuum to these channels, the outer wall of the flexible membrane is held in its position during the deflation cycle of the discharge operation.

Figure 6:
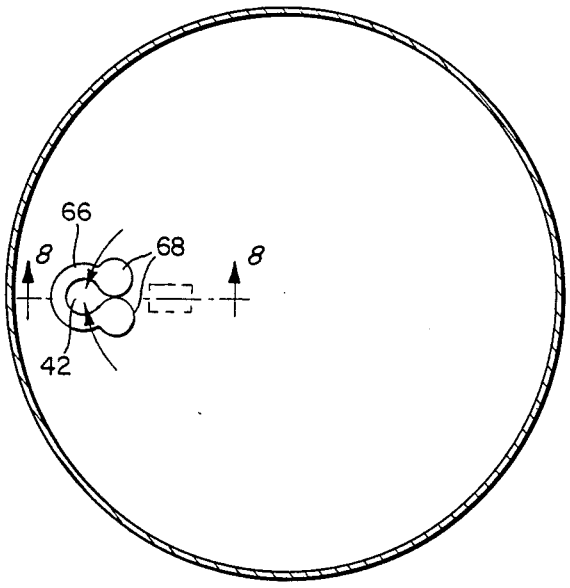
FIG. 6 is a top plan view taken along line 6—6 of FIG. 2 and illustrating a scalloped discharge ring for guiding of the billowing of the membrane during inflation.

In the embodiment illustrated in FIG. 6 there is a clamping ring 66 of suitable configuration to provide an area of attachment or mating edge which clamps the flexible membrane in an area of the discharge opening 42. This clamp ring may have large multiple lobes or ears 68 which extend outwardly from an annular periphery to predetermine where the folds will form in the membrane during inflation. This in turn will preclude the formation of excessive or large folds which might entrap material during the discharge cycle.

Depending upon the flowability and other characteristics of the material such as hydroscopicity, compaction, granular size, etc., in brown sugar or plastic pellets for example, the shape of the clamping ring may be circular, irregular or non-symetrical to provide a suitable "restraining" area 67 (see FIG. 8) of attachment on the outermost perimeter of the clamping ring of the membrane. For example, in a nine foot diameter bin having a discharge opening varying from 6 inches to 15 inches (approx. standard size) the normal restraining or attachment area required would have a perimeter of approximately 50 inches. Thus the clamping ring would be configured or shaped such that a restraining perimeter of 50 inches would result where the membrane is attached. In an 18 foot diameter bin, a clamping ring configured to have an attachment perimeter of 190 inches would be required to effectively guide the flexible membrane during inflation so as to prevent excessive creasing and folding and thereby trapping material between folds as it is discharged.

Figure 7:
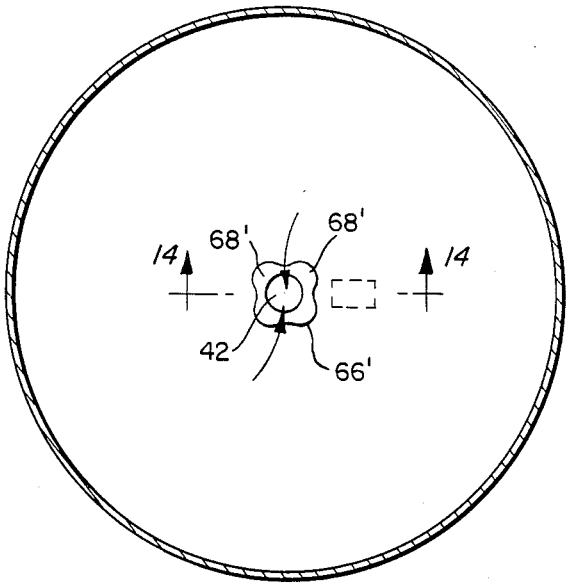
FIG. 7 is a top plan view of a discharge opening when the invention is embodied in a center discharge bin.

FIG. 7 shows another embodiment of the invention in which there is a center discharge opening 42'. In this case the clamp ring 66' has four lobes 68' functioning in the manner described above. In practice it is found best to have the center discharge opening slightly offset of center, e.g. one foot offset in a 12 ft. diameter bin for better control of the discharge.

Figure 8:
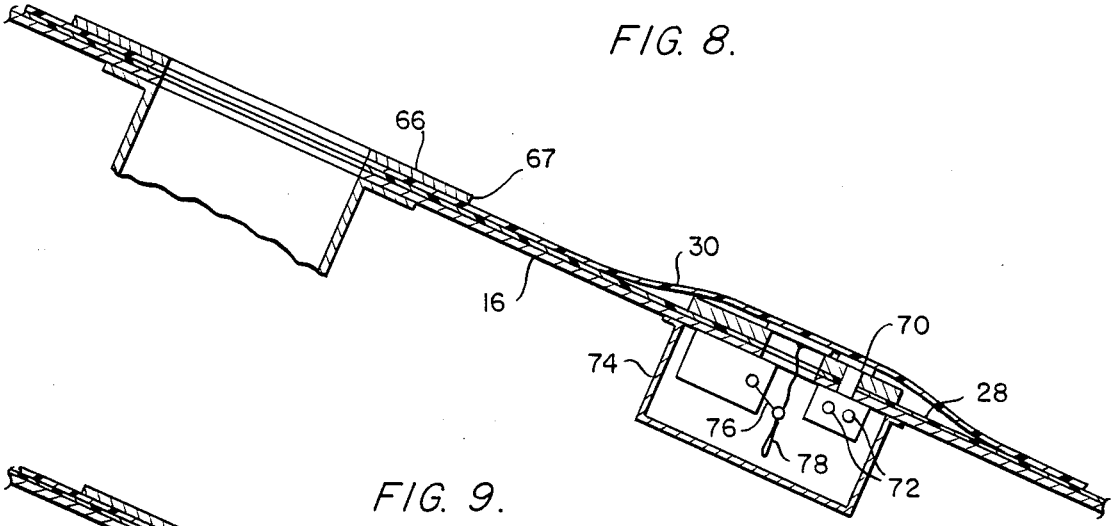
FIG. 8 is a section view taken along line 8—8 of FIG. 6.
Figure 9:
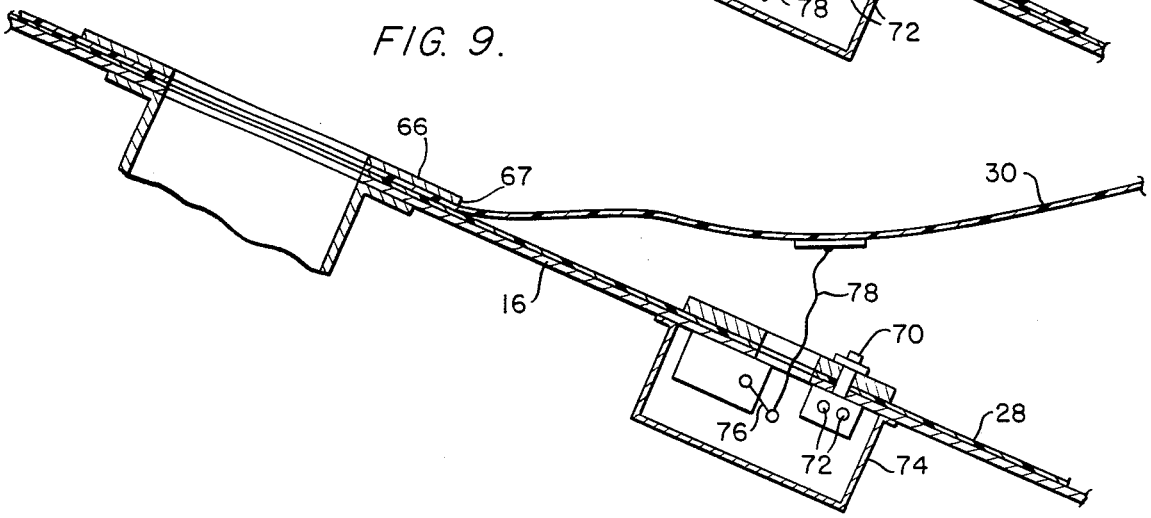
FIG. 9 is a detailed view similar to FIG. 8 showing the components and other positions during the discharge cycle.
Figure 11A:
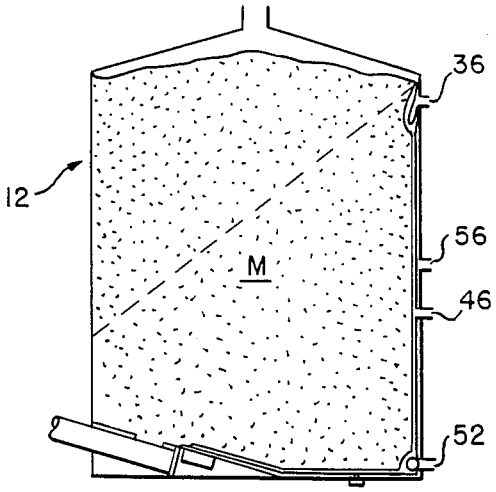
Figure 11B:
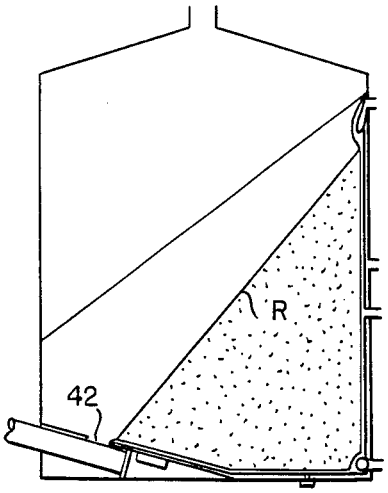

As shown in FIGS. 8 and 9, control of the membrane during the discharge cycle is provided by a sensor switch 70 in cooperation with sensors 72 in housing 74 located between walls 28 and 30 of the membrane which will sense whether the membrane is resting against the bottom or lifted from the bottom. In addition, there is a limit switch 76 connected by a flexible tether 78 to the inner wall of membrane 26. During the discharge cycle, and particularly when nearing completion of the discharge cycle, membrane 26 will lift off the floor and activate switch 70 indicating initial membrane deployment. When the membrane reaches its limit, tether 78 operates limit switch 76 indicating the discharge cycle is completed and a vacuum is applied to return the membrane to its original position.

Figure 10A:
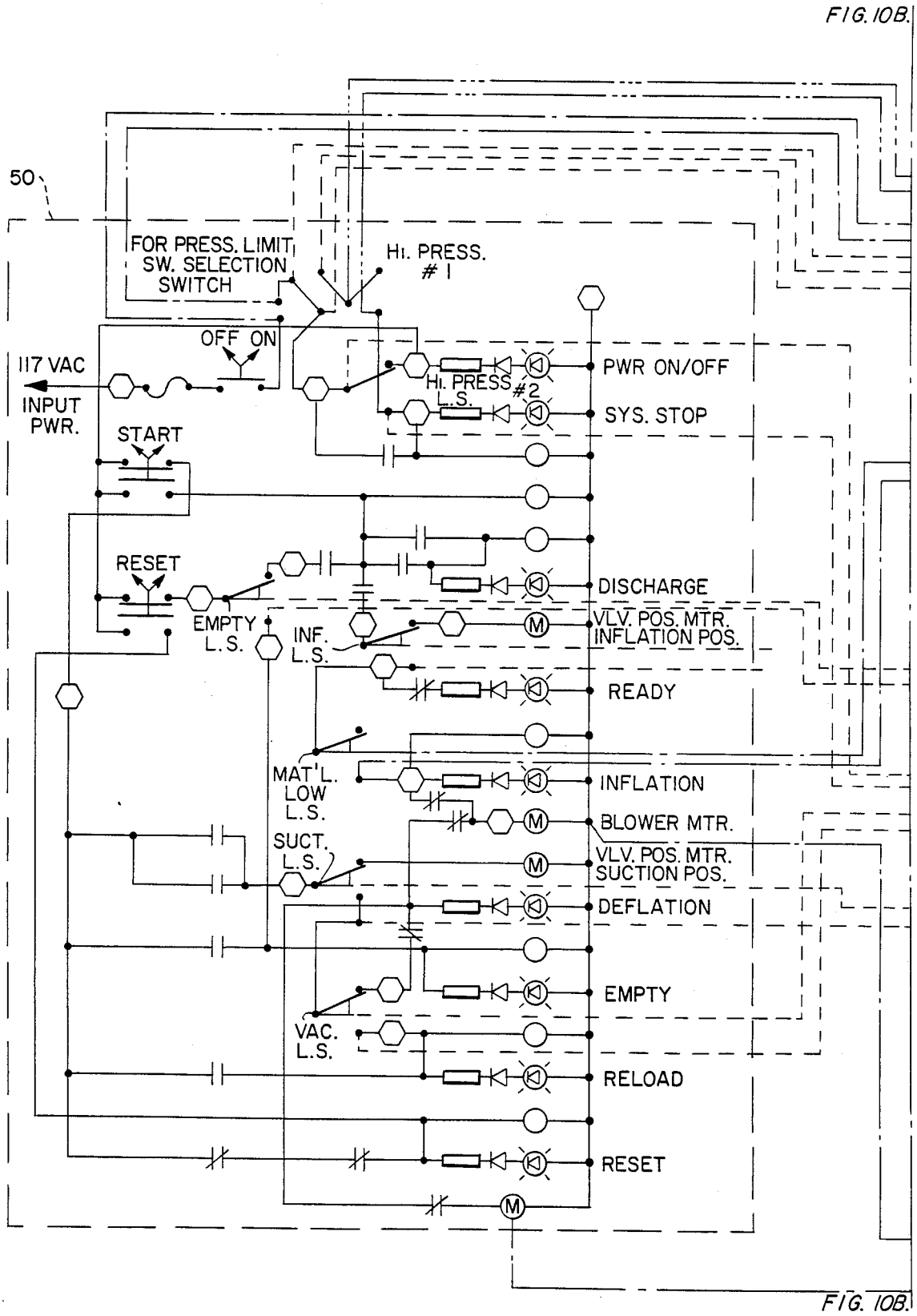
FIGS. 10A and 10B are partial detailed, elevation views showing one embodiment and related control circuitry of the components during the discharge cycle in a side-discharge bin.
Figures 10A, 10B:
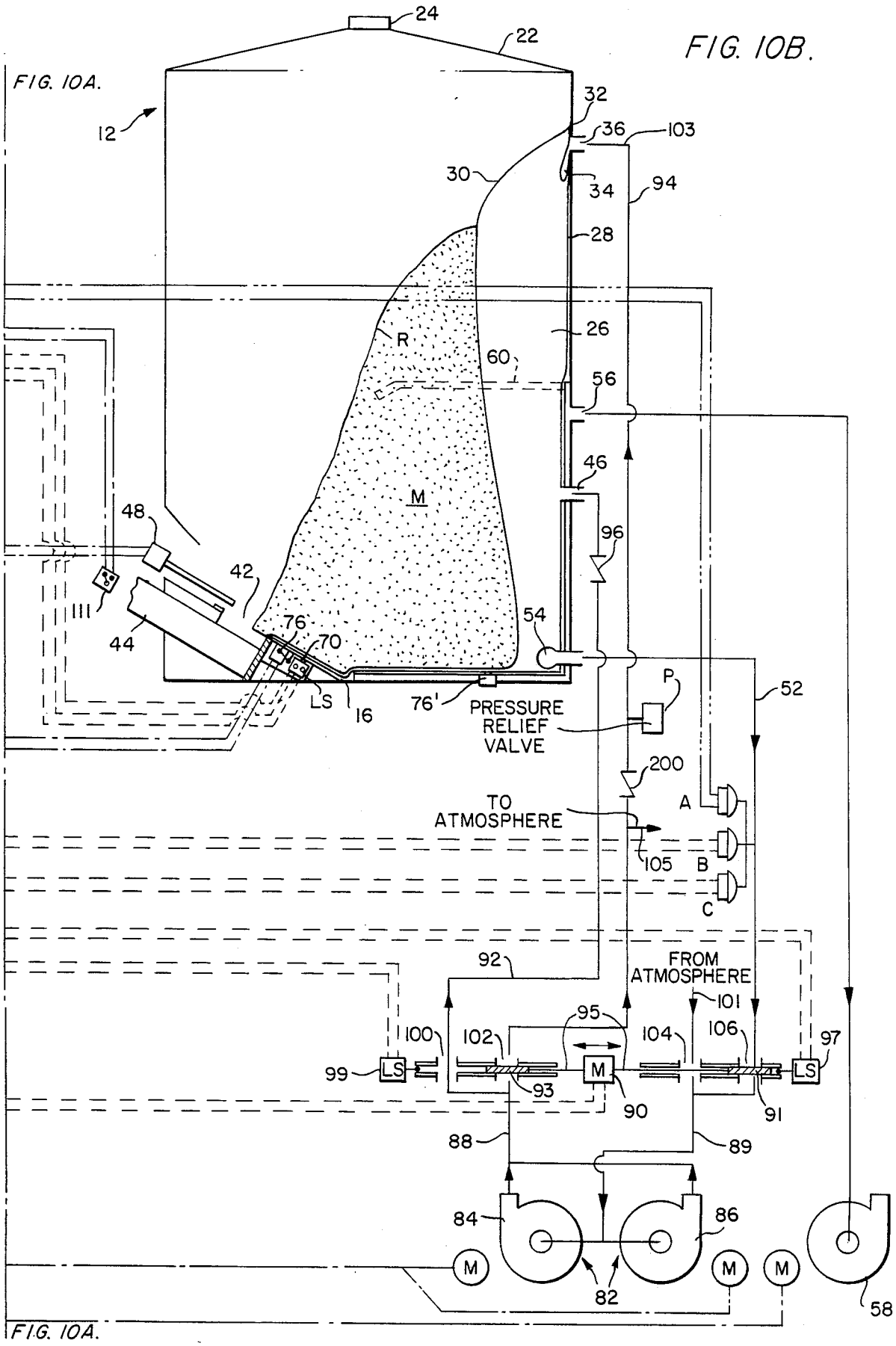
Figure 11C:
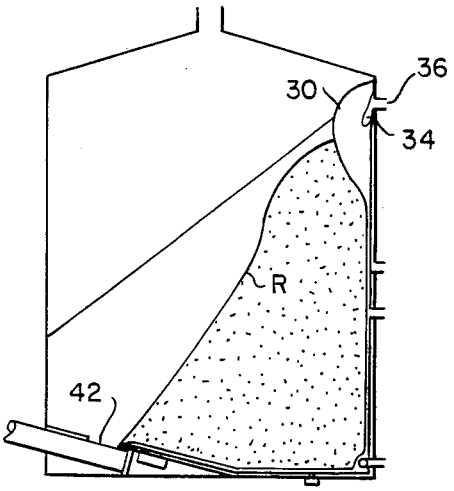
Figure 11D:
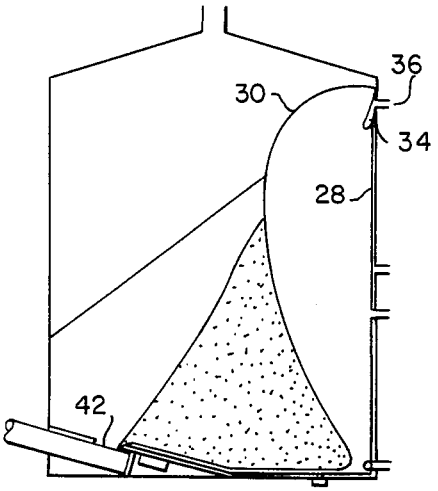
Figure 11E:
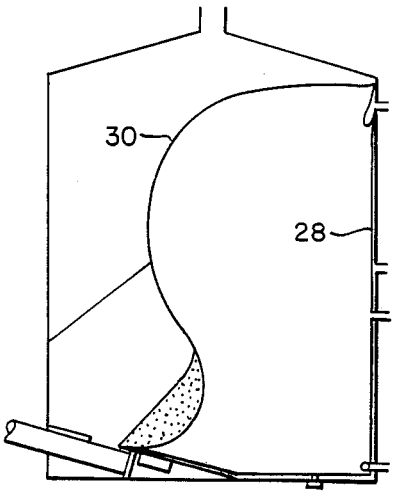
Figure 11F:
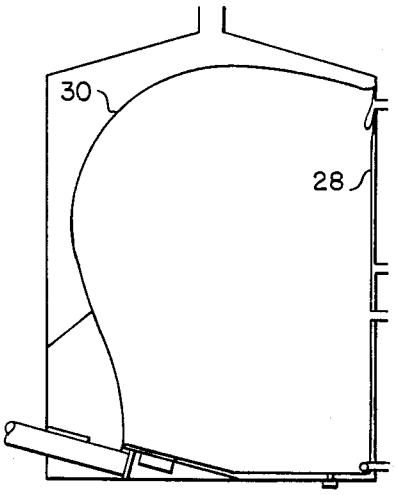

Referring to FIGS. 10A and 10B wherein the same reference numbers indicate the same parts as previously described, a bin 12 of this invention is especially suitable and adapted or bulk storage and handling (discharging) free flowing granular material by means of automatic controls.

In operation, the bin is initially filled with the bulk material to be stored, e.g. sugar, rice, corn, powders, grains, etc. This material should be free flowing material and of a type which can be handled within the bin. When it is desired to discharge material from the bin, a gate (not shown) is opened and the material flows out of the bin and out of the discharge opening until such time as it approximates its angle of repose and uncovers the sensor or bin material indicator 48. When it senses the absence of material, the indicator gives a signal to the control box 50 to start inflating the bag by relatively low pressure from the blower system 82. The upper portion of the membrane starts inflating by the inner wall 30 bulging inwardly and the material continues to flow and the bag wall continues to expand as shown in FIGS. 11A through 11F. During discharge when the material covers the sensor 48 the inflation stops. A check valve 96 holds the low pressure, and the material discharges by gravity until it again uncovers the indicator. This cycle is many times repeated during a discharge cycle.

As the membrane inflates the inclined shelf 16 provides resistance against the loaded membrane and shifts the center of gravity of the load away from the discharge opening so that the membrane cannot inch forward even though the membrane liner has lifted off the floor. Without this resistance, the air cushion forming beneath the liner may allow forward movement of the inflating membrane and material supported thereon. This would cause an excess of slack membrane liner material to "bulge" or collect at the discharge opening and prevent the membrane from resuming its original configuration against the bin wall during the deflation cycle if the bin were not completely emptied of material. Should this occur, the liner could fail due to the inability of the liner to assume or conform to its normal position when the bin is empty.

For inflation and deflation of the bag there is provided a blower system 82, including blowers 84 and 86, having an outlet line 88 in cooperation with a servo motor 90 including actuator 91 and valves 100, 102, 104 and 106 for controlling whether the output of the blower is directed to inflating the inflatable bag through line 92, inflating annulus 34 through line 94 and check valve 200, deflating bag 26 through line 52 or venting to atmosphere. Line 92 is provided with a check valve 96 to prevent collapsing of the bag during an emptying cycle or if the blower stops. In addition, mechanical pressure relief valve P is provided on line 94 to gradually bleed off air held in annulus 34 when material introduced into the bin presses against the annulus or as the membrane is pulled down and conforms to the bin wall. Vacuum line 52 is also connected to the blower system and controlled by valve 106. In addition, line 94 has a check valve 200 to prevent premature deflation. Control box 50 is provided with suitable controls for controlling valves 100, 102, 104 and 106.

To assist in determining the extent to which the membrane has inflated which in turn would indicate the amount of material remaining in the bin, a limit switch 76' may be provided as shown, for example, in FIG. 10B. Since in the case of a center discharge bin the discharge opening is offset and closer to one side of the bin, the membrane inflates in a set pattern because the membrane will inflate following the path of least resistance between the side wall and the discharge opening. Therefore, limit switch 76' will be activated when the membrane has inflated to a predetermined point which in turn signals the operator that additional material may be introduced into bin 12 if desired.

During the discharge cycle sensor switch 70 is pre-set to monitor the air pressure applied to the bag by the blower system. This is accomplished by allowing sensor switch 70 to selectively activate sensors A and B during the discharge cycle. One sensor monitors the air pressure within the membrane until it lifts off switch 70. When membrane 26 is resting against the bottom of bin 12, sensor switch 70 is depressed and operates switch A (see FIGS. 10A and 10B) so that the air pressure within the membrane is below 50 inches water, i.e. within normal limits. Near the completion of the discharge cycle, the membrane will lift off of the sensor switch. At this time sensor 70 will deactivate switch A and activate switch B through control box 50 and will continue to monitor the air pressure condition of the membrane. If the system is functioning properly and the air pressure within pre-determined limits, limit switch 76 connected by a flexible tether 78 to the underside of the membrane as shown in FIG. 9 will be activated when tether 78 is pulled taut due to the membrane being fully inflated. This indicates that the bin is empty, and the deflation cycle will be initiated and membrane 12 will be emptied of air by blower system 82. When membrane 26 is depleted of air and has settled back and conformed to the silo wall and floor, a momentary vacuum occurs which will activate switch C. Switch C then sends a signal to control box 50 shutting off the blower system and the balloon 34 near the top of membrane is inflated to assure that enough slack exists so that the walls of membrane 26 are not unduly strained when again loaded with bulk materials. Check valve 200 precludes deflation of balloon 34 during the loading sequence.

If during the discharge cycle sensor B detects abnormally high pressure within membrane 26 such as might be caused by broken tether 78 or other malfunction, the cycle is interrupted and a visual signal on the control box illuminated. As a further safety backup, conveyor means 44 is provided with switch 111. If the conveyor should malfunction or.be turned off for any reason while the rest of the system is functioning, then switch 111 will shut the system down.

Figure 2:
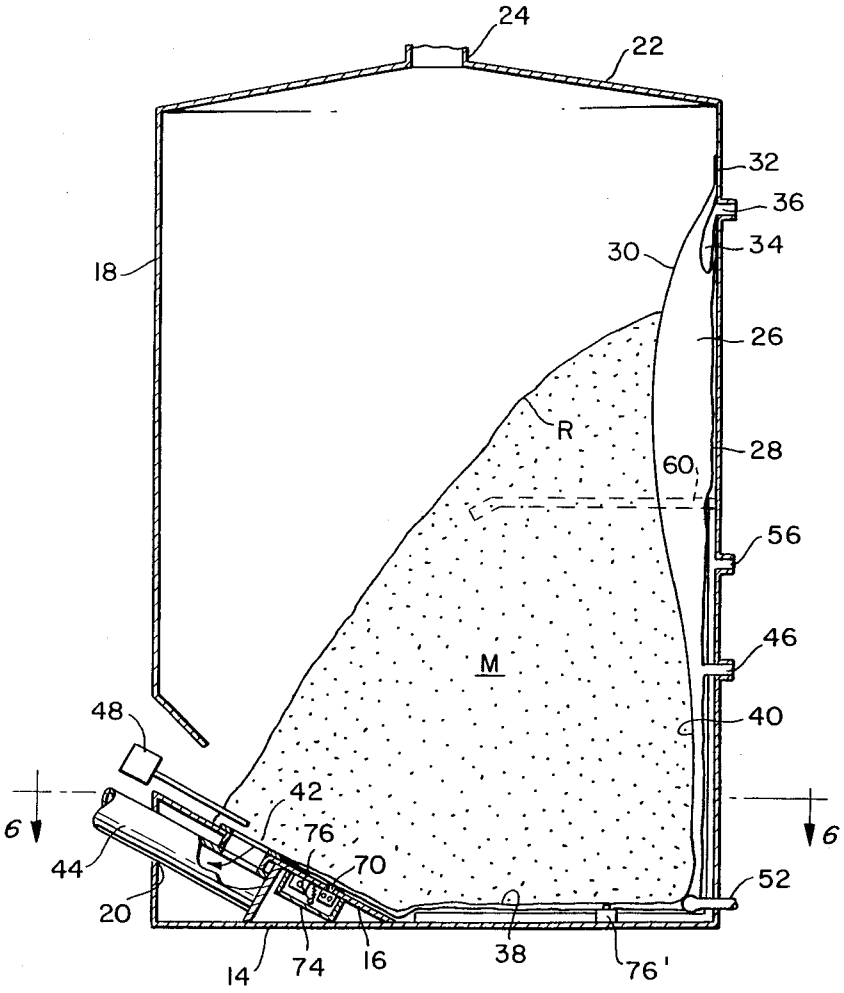
FIG. 2 is a sectional view taken along line 2—2 of FIG. 1 showing the bin schematically.
Figure 1:
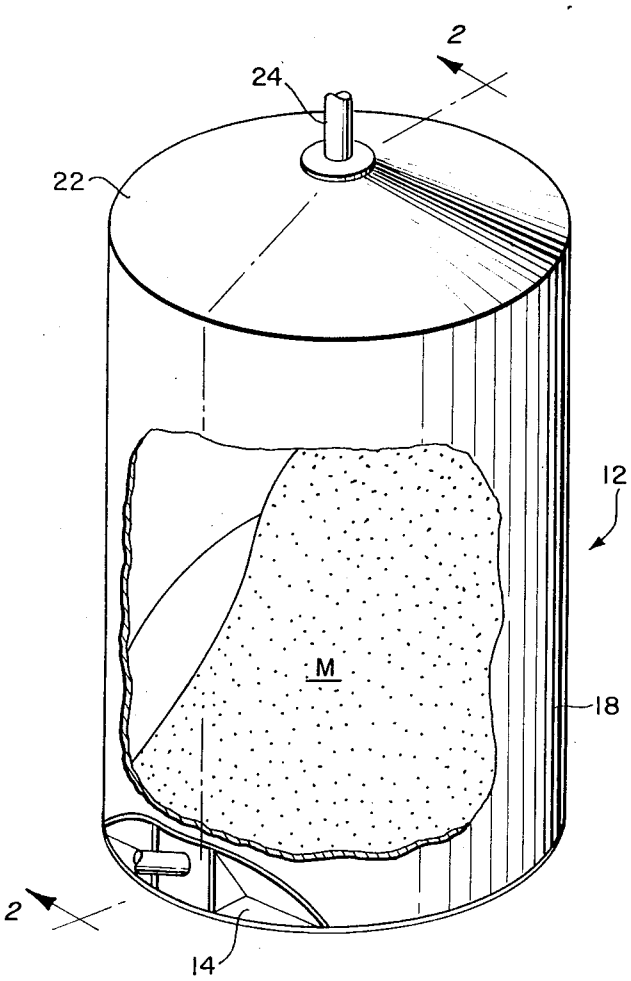
FIG. 1 is a perspective view of a portion broken away and cut away illustrating one type of bin in which the improvements of this invention are applicable.

As discussed above, the outer wall 28 of the dual-walled flexible membrane 26 is retained against the wall 18 of bin 12 at intermediate and lower positions by employing vacuum connection 56 in conjunction with the auxiliary blower. This vacuum connection communicates with perforated circular loop 60, down channels 62, and cross-bottom channel 64. In a side-discharge bin, loop 60 is modified as shown in phantom line in FIG. 2 to pass only partially around the bin wall. When a vacuum is applied, the outer wall of membrane is held snugly against the bin side wall and floor during deflation.

In a center discharge opening system perforated cross-bottom channel 64 may be modified to circumscribe the center opening therby assuring that the bottom-side of outer wall 28 would be held in position against the bottom surface of the bin.

FIGS. 12A and 12B show another and presently preferred embodiment in relation to the inflatable membrane of a side-discharge bin. The parts illustrated therein which are substantially the same as those in FIG. 2 bear the same reference numberals.

There is disclosed a secondary flexible single liner or membrane 114 secured at one end to ring clamp 66 nearest the discharge opening and at the opposing end to inner wall 30 of membrane 26 such as by heat fusion or other suitable means. As indicated in the previous embodiments, clamp 66 serves to prevent the membrane from trapping bulk material in its folds during the final stages of discharge. However, the broad face of the clamping ring prevents some material in the bottom of the bin from being discharged so the secondary membrane provides a means for discharging the material which would otherwise rest on the clamping ring.

As illustrated in FIG. 12A, sensor switch 70 and limit switch 76 are spatially relocated in relation to membrane 26 and secondary membrane 114. In addition, a fixed or flexible conduit or fluid passage 116 is positioned in communicative relationship between the membranes. At the end of conduit 116 terminating beneath membrane 26 in floor 14, a flapper valve 118 is connected to the outer wall of member 26 by a flexible tether 120. The opposing open end of conduit 116 terminates in communicative position below secondary membrane 114. Located adjacent thereto is limit switch 76 attached to flexible tether 78. The functional operation of sensor switch 70 and switch 76 are as previously described. As shown in FIG. 12B, when the membrane has fully deployed, tether 120 causes flapper valve 118 to open allowing fluid such as air to bleed off from membrane 26 and inflate the secondary membrane. When the secondary membrane has fully inflated, limit switch 76 is activated by tether 78 and sends a signal to control box 50 indicating that the bin is empty of material. At this time, the blower system would cease inflating membrane 26 and the deflation cycle would begin. As the primary membrane deflates and collapses onto the bottom of the bin, it will cause the secondary membrane to be pulled taut which will force the inflating fluid or air out through conduit 116 and back into membrane 26 where it will be withdrawn during the deflation cycle.

A center discharge embodiment is shown in FIG. 13 wherein parts which are substantially the same as in the prior embodiments have the same reference number. The discharge opening 42' is surrounded by a clamping ring 66' to which is secured membrane 26' and secondary membrane 114'. As shown in FIGS. 14 and 15, the secondary membrane is joined to the primary membrane in overlapping relationship. The parts illustrated function in the same manner and controlled bY the same control elements as in the side-discharge bin and will not be discussed in detail. The flexible or fixed conduit 116' is generally of "U" shaped configuration and is positioned in communicative relationship between the membranes. Flapper valve 118' controls fluid flowing from the primary membrane to the secondary membrane. FIGS. 16 and 17 further illustrate the functional relationship of the elements in the discharge cycle of a center discharge bin.

As can be seen the invention disclosed provides a unique pneumatically assisted handling and discharqe means for granular free flowing material in which the bin for storing the material is simple and inexpensively constructed, it has uniform weight distribution over a supporting floor and can automatically assist in discharging material beyond the angle of repose by automatically inflating the supporting double walled bag. As compared with conventional bulk storage devices and hoppers the present invention presents dramatic differences in size of the silos required, shipping weight, erection time equipment and costs, floor loading, maintenance and cost.

What is claimed is:

1. A material-handling and storage bin of the type having a fluid-expanded flexible membrane for assisting in gravity discharge of free-flowing granular material after such material partially discharges by action of gravity by rolling material into a conical area inside an angle of repose through cyclicly expanding the flexible membrane, the material discharging through a discharge opening where the membrane is secured to the bin, with improvements for assisting the flexible membrane in providing complete discharge on its expansion, the improvements comprising; a clamping ring providing a mating edge which secures the flexible membrane to the discharge opening in the bin, the mating edge including a plurality of lobes extending outwardly from a periphery of the clamping ring which precludes excessive folding and creasing of the flexible membrane on its expansion under pressure.

2. A material-handling and storage bin as defined in claim 1 wherein the mating edge extends all around the edges of the clamping ring and the discharge opening is approximately in the center of the bottom of the bin.

3. A material-handling and storage bin as in claim 1 wherein the discharge opening is adjacent one side wall of the bin and the mating edge extends around only a portion of the clamping ring.

4. A material-handling and storage bin as in claim 1 further comprising, supplemental discharge means for discharging free-flowing granular material remaining on a top flat surface of the clamping ring following full expansion of the flexible membrane.

5. A material-handling and storage bin as defined in claim 4 wherein the supplemental discharge means comprises a supplemental flexible membrane having a supplemental air inlet for expansion thereof, said supplemental flexible membrane being secured to an inner edge of said clamping ring at the discharge opening and to an inner wall of said flexible membrane, means for introducing fluid pressure into said supplemental air inlet for expanding the supplemental flexible membrane and discharging any material resting thereon.

6. A material-handling and storage bin of the type having an inflatable, dual walled, cup-shaped bag, positioned inside silo side walls and clamped to the side walls adjacent the top of the bag, a discharge opening through the bottom of the bin, the bag assisting in gravity discharge of free-flowing granular material after such material partially discharges by the action of gravity by rolling material into a conical area inside an angle of repose of the material through cyclicly expanding the inner inflatable wall of the dual-walled bag, with improvements for holding the outer wall of the dual-walled bag to the silo side walls below the top of the bag, the improvements comprising; means for applying vacuum between the outer wall of the bag and the silo side wall at an area below where the top of the bag is clamped to the side wall.

7. A material-handling and storage bin as in claim 6 wherein the vacuum means is a perforated member extending circumferentially along the periphery of the silo wall and connected to a source of vacuum outside the silo wall.

8. A material-handling and storage bin as defined in claim 7 wherein the perforated member also extends vertically down the side wall and across the floor of the bin.

9. A material-handling and storage bin as in claim 8 wherein the perforated member is a perforated channel.

10. A material-handling and storage bin of the type having a fluid expandable, flexible membrane for assisting in gravity discharge of free-flowing granular material after such material partially discharges by action of gravity by rolling material into a conical area inside an angle of repose through cyclicly expanding the flexible membrane, the material discharging through a discharge opening where the membrane is secured to the floor, with improvements in safety controls for applying pressure to the flexible membrane, the improvements comprising: a first sensing means for sensing when the flexible membrane has lifted from the floor of the bin adjacent the discharge opening, and a second sensing means for sensing when the flexible membrane has reached a position at the end of a material discharge cycle, said first sensing means monitoring the pressure to be applied to the flexible membrane in a discharge cycle.

11. A material-handling and storage bin as in claim 10 wherein the first sensing means is an electrical switch capable of detecting the position of the flexible membrane on the floor of the material-containing bin.

12. A material-handling and storage bin as defined in claim 11 wherein said second sensing means is a tether actuated electrical switch in communication with said flexible membrane and actuated when said flexible membrane has expanded to a predetermined position in a discharge cycle.

13. A material-handling and storage bin of the type having a fluid expandable flexible membrane for assisting in gravity discharge of free-flowing material after such material partially discharges by action of gravity wherein said membrane assists in material discharge by rolling material into a conical area inside an angle of repose through cyclical expansion of said flexible membrane such that the material discharges through a discharge opening where the membrane is secured to the bin, with improvements in automatic controls for the bin comprising: switch means for controlling the application of fluid pressure to said flexible membrane; probe means for sensing the presence of material being discharged, said probe means positioned to sense the presence of material flowing out the discharge opening, said probe means controlling said switch means for the application of fluid pressure to said membrane when there is no material sensed by said probe means and to turn off said switch means for the application of fluid pressure when there is material sensed by the probe means discharging through the discharge opening; a silo empty switch for sensing when the membrane has expanded to an extent indicative of an empty silo; means for applying vacuum to retract said flexible membrane, said silo empty switch controlling said means for applying vacuum; a vacuum sensing switch, said vacuum sensing switch sensing when said flexible member has returned to its non-expanded position and to turn off said means for applying vacuum; and an excess pressure safety-sensing switch to detect excess pressure and shut off said switch for controlling fluid pressure application to said flexible membrane.

14. A material-handling and storage bin of the type having a fluid-expandable flexible membrane for assisting in gravity discharge of free-flowing granular material after such material partially discharges by action of gravity by rolling material into a conical area inside an angle of repose through cyclicly expanding the flexible membrane, the material discharging through a discharge opening where the membrane is secured to the bin, with improvements for assisting the flexible membrane in providing complete discharge of material on its expansion, the improvement comprising: a built-up bin floor having an inclined portion which slants downwardly and away from the discharge opening and extending downwardly toward the side of the bin opposite the discharge opening, said downwardly inclined portion underlying and supporting a portion of the flexible membrane about the discharge opening to thereby resist horizontal movement of the flexible membrane and the material towards the discharge opening during inflation of the membrane and discharge of material.

15. The material-handling and storage bin as defined in claim 14 wherein the discharge opening is adjacent one sidewall of the bin.

16. The material-handling and storage bin as defined in claim 14 wherein the discharge opening is generally centrally located at a bottom portion of the bin.

17. A material-handling and storage bin of the type having a floor portion and a fluid-inflatable flexible membrane for assisting in gravity discharge of material, after such material discharges to the extent allowed by gravity, by nudging material towards a discharge area through cyclical inflation of the flexible membrane, the material discharging through a discharge opening where the membrane is secured to the bin, with improvements for inhibiting the flexible membrane from sliding towards the discharge opening during discharge, the improvements comprising: the discharge opening being elevated from the floor of the bin, and a downwardly inclined shelf extending between the discharge opening and the floor of the bin, the downwardly inclined shelf underlying and supporting a portion of the flexible membrane about the discharge opening to thereby resist horizontal movement of the flexible membrane and the material towards the discharge opening during inflation of the membrane and discharge of material.

18. The material-handling and storage bin as defined in claim 17 wherein the discharge opening is adjacent one sidewall of the bin.

19. The material-handling and storage bin as defined in claim 17 wherein the discharge opening is generally centrally located at a bottom portion of the bin.

20. A material-handling and storage bin of the type having a fluid-inflatable primary flexible membrane for assisting in gravity discharge of material, after such material discharges to the extent allowed by gravity, by nudging material towards a discharge area through cyclical inflation of the primary flexible membrane, the material discharging through a discharge opening where the primary membrane is secured to the bin by a clamping ring, with improvements for assisting the primary flexible membrane in providing complete discharge on its expansion, the improvements comprising a secondary flexible membrane and a supplemental air inlet for expansion thereof for discharging material remaining on a top surface of the clamping ring following inflation of the primary flexible membrane, the secondary flexible membrane being secured to the bin at the discharge opening and to an inner wall of said primary flexible membrane, the secondary membrane extending over said clamping ring, and means for introducing fluid pressure into the supplemental air inlet for inflating the secondary membrane and discharging any material resting on the clamping ring after inflation of the primary flexible membrane.

* * * * *